United States Patent [19]

De Milt et al.

[11] 3,991,668

[45] Nov. 16, 1976

[54] SHREDDER-COMPACTOR APPARATUS FOR PROCESSING REFUSE MATERIAL

[75] Inventors: Kenneth E. De Milt, Scotch Plains; Stephen Collins, Monmouth Beach, both of N.J.

[73] Assignee: SFM Corporation, Plainfield, N.J.

[22] Filed: Dec. 27, 1974

[21] Appl. No.: 536,809

[52] U.S. Cl. ..... 100/98 R; 100/48; 100/147

[51] Int. Cl.[2] ..... B30B 1/18; B30B 15/14

[58] Field of Search ..... 100/43, 98 R, 147, 148, 100/145, 48, 41, DIG. 3, DIG. 8, 94, 95, 96, 97, 117, 150; 241/36, 82.1, 246, 247

[56] References Cited

UNITED STATES PATENTS

| | | | |
|---|---|---|---|
| 1,876,064 | 9/1932 | Lang | 100/147 X |
| 2,549,997 | 4/1951 | Zies et al. | 100/147 X |
| 2,796,901 | 6/1957 | Autio | 241/82.1 |
| 3,044,391 | 7/1962 | Pellett | 100/97 X |
| 3,547,577 | 12/1970 | Lovercheck | 100/97 |
| 3,683,796 | 8/1972 | Miner et al. | 100/145 |
| 3,760,717 | 9/1973 | DeMilt et al. | 100/98 R |
| 3.845,907 | 11/1974 | Schwarz | 241/36 |

*Primary Examiner*—Billy J. Wilhite
*Attorney, Agent, or Firm*—Bruce L. Adams

[57] ABSTRACT

A shredder-compactor apparatus has a hopper for receiving refuse material to be processed and a compaction tube arranged to receive the refuse material from the hopper. A rotary auger screw extends along the hopper and through the compaction tube and coacts with a breaker bar located in the hopper to shred and tear the refuse material in response to rotation of the auger screw. As the auger screw rotates, the shredded refuse material is transported axially through the compaction tube and compacted therein. In the transition region between the hopper and compaction tube, the auger screw has a truncated screw section which is reduced in dimension compared to the remainder of the auger screw so as to facilitate entry of the shredded material into the compaction tube. The compaction tube has a set of wear plates removably mounted at circumferentially spaced intervals around its inner wall and the wear plates are formed of a material which is less hard than the auger screw to ensure that the wear plates themselves wear down rather than the auger screw thereby prolonging the life of the auger screw. A spring-loaded latch assembly is provided at the discharge end of the compaction tube to maintain the back-pressure of the compacted material within predetermined limits. A reversible electric motor is connected through a transmission to rotationally drive the auger screw, and control circuitry effects driving of the motor according to a predetermined program such that the auger screw is rotationally driven in both the forward and reverse directions, in repeated cycles, in order to assist in feeding the material from the hopper and to prevent jamming of the material in the compaction tube.

9 Claims, 10 Drawing Figures

SHREDDER-COMPACTOR APPARATUS FOR PROCESSING REFUSE MATERIAL

BACKGROUND OF THE INVENTION

The present invention relates generally to the processing of refuse and other waste materials and more particularly, to an apparatus for shredding and compacting refuse.

Many types of apparatus for processing garbage, trash and other refuse are known in the art and which function to comminute the waste material and then compact it to reduce its volume so as to form plugs of highly compacted refuse which may be conveniently collected and handled. The older apparatus of this type usually employed a reduction mill or pulverizer for comminuting the waste material after which the material was fed through a feed chute to a compactor. The major disadvantages of such apparatus are their relative complexity and large size coupled with high manufacturing and maintenance costs. As the demand for simpler and less expensive apparatus increased, the older apparatus gave way to a new generation of combined shredder-compactor apparatus.

One such shredder-compactor apparatus which has proven highly successful in the field is the auger screw type. The auger screw type apparatus employs a rotary helical screw mounted within a housing which normally has a hopper and a compaction tube such that the waste material is received and shredded in the hopper and delivered to the compaction tube wherein it is compacted. The helical auger screw extends through both the hopper and compaction tube and is constructed so that the angular friction with respect to the refuse material is such that the screw effects compaction and reduction in volume of the comminuted material during its passage through the apparatus. As the auger screw rotates, it captures the refuse in the hopper and coacts with means located in the hopper to shred, shear and comminute the refuse and force the same into the compaction tube wherein the auger screw compacts and discharges the refuse in the form of highly densified plugs.

As a consequence of the large demand for shredder-compactor apparatus, much time and expense has been devoted toward improving the apparatus so as to simplify its installation, lower its price, make it more easy to operate and minimize its maintenance. Despite these objectives and notwithstanding the many improvements which have been made to date, the shredder-compactor apparatus which are currently available suffer several drawbacks. One drawback is that the auger screw wears very rapidly, especially if used with glass refuse. One approach taken to solve this problem was to harden the auger screw and though this successfully prolonged the life of the screw, it caused rapid wearing and deterioration of the compaction tube.

Another drawback is that certain refuse, such as cloth, fabric, and large plastic sheets, tend to move outwardly toward the crown of the auger screw and cling onto the screw so that they rotate with the screw rather than advance axially through the compaction tube thereby creating blockages in the compaction tube. In order to solve this problem, it has been proposed to form axial slots in the compaction tube so as to break up the clinging action of the material and cause it to advance lengthwise along the tube. Unfortunately, the slots quickly become clogged with refuse thereby losing their effectiveness and therefore removable cover plates had to be provided to gain access to the slots for maintenance purposes. However, each time the cover plates are removed and replaced, the seal around the slots beomes less effective and invariably waste material beings to ooze out beneath the cover plates.

Another drawback of the prior art shredder-compactor apparatus is that of maintaining sufficient back-pressure at the discharge end of the compaction tube to enable high density compaction to occur. If the back-pressure is too low, the material is not adequately compacted whereas if the back-pressure is too high, the material compacts too much and becomes so dense that overheating occurs which causes the material to adhere to the walls of the compaction tube. The devices currently employed to control the back-pressure, for the most part, are complex and expensive and unreliable in operation.

A further drawback of the currently available shredder-compactor apparatus is that the material tends to jam in the apparatus, especially near the discharge end of the compaction tube. Though automatic equipment has been added to automatically shut down the apparatus in this event, no practical solution has been devised to prevent jamming of the material or of relieving material blockages.

SUMMARY OF THE INVENTION

It is therefore a principal object of the present invention to provide a shredder-compactor apparatus which shreds and then compacts refuse material and which overcomes the aforementioned drawbacks.

It is another object of the present invention to provide a shredder-compactor apparatus having a set of wear plates removably mounted within the compaction tube which function to both accept wear from the auger screw thereby lengthening its useful life and to act as circumferential discontinuities around the interior of the compaction tube thereby preventing material from clinging onto and rotating with the auger screw.

It is a further object of the present invention to provide a shredder-comparator apparatus employing a novel auger screw which has a short arcuate section of reduced dimension compared to the remainder of the screw so as to alleviate blockage of material at the entrance to the compaction tube.

It is yet another object of the present invention to provide a shredder-compactor apparatus employing a simple yet reliable means for controlling and maintaining the material back-pressure at the discharge end of the compaction tube.

A still further object of the present invention is to provide a shredder-compactor apparatus having means for cyclically driving the auger screw in both forward and reverse rotational directions in a predetermined sequence so as to prevent jamming of the material.

It is still another object of the present invention to provide a shredder-compactor apparatus which is small in size, inexpensive to both manufacture and maintain, easy to install and operate, and which is reliable and has a long life.

The above and other objects of the present invention are realized by a shredder-compactor apparatus having a hopper for receiving refuse material and a compaction tube connected to receive the material from the hopper. A rotary auger screw extends along the hopper and through the compaction tube. Means are disposed in the hopper section for coating with the auger screw to shred the refuse material and as the screw rotates, the shredded and comminuted material is transported axially through the compaction tube and compacted therein. In the region where the auger screw enters the compaction tube, the auger screw has a short arcuate section which is reduced in dimension compared to the remainder of the auger screw to facilitate entry of the shredded material into the compaction tube. The compaction tube contains a set of water plates removably mounted at angularly spaced intervals around its inner wall and the wear plates are formed of a material which is less hard than that of the auger screw. At the discharge end of the compaction tube, a spring-loaded latch assembly is provided to maintain the back-pressure of the compacted material within predetermined limits so as to control and optimize the compaction pressure. An electric motor acts through a transmission to rotationally drive the auger screw and a control circuit operates the motor according to a predetermined program such that the auger screw is rotationally driven in both the forward and reverse directions in repeated cycles in order to assist feeding the material from the hopper and to prevent jamming of the material in the compaction tube.

Having in mind the above and other objects that will be evident from a reading of this disclosure, the present invention comprises the combination and arrangements of parts illustrated in the presently preferred embodiment of the invention which is hereinafter set forth in sufficient detail to enable those persons skilled in the art to clearly understand the function, operation, construction and advantages of it when read in conjunction with the accompanying drawings.

BRIEF DESCRIPTION OF THE DRAWINGS

Throughout the drawings, like reference characters are used to denote like parts in the various views.

DESCRIPTION OF PREFERRED EMBODIMENT

Figure 1:
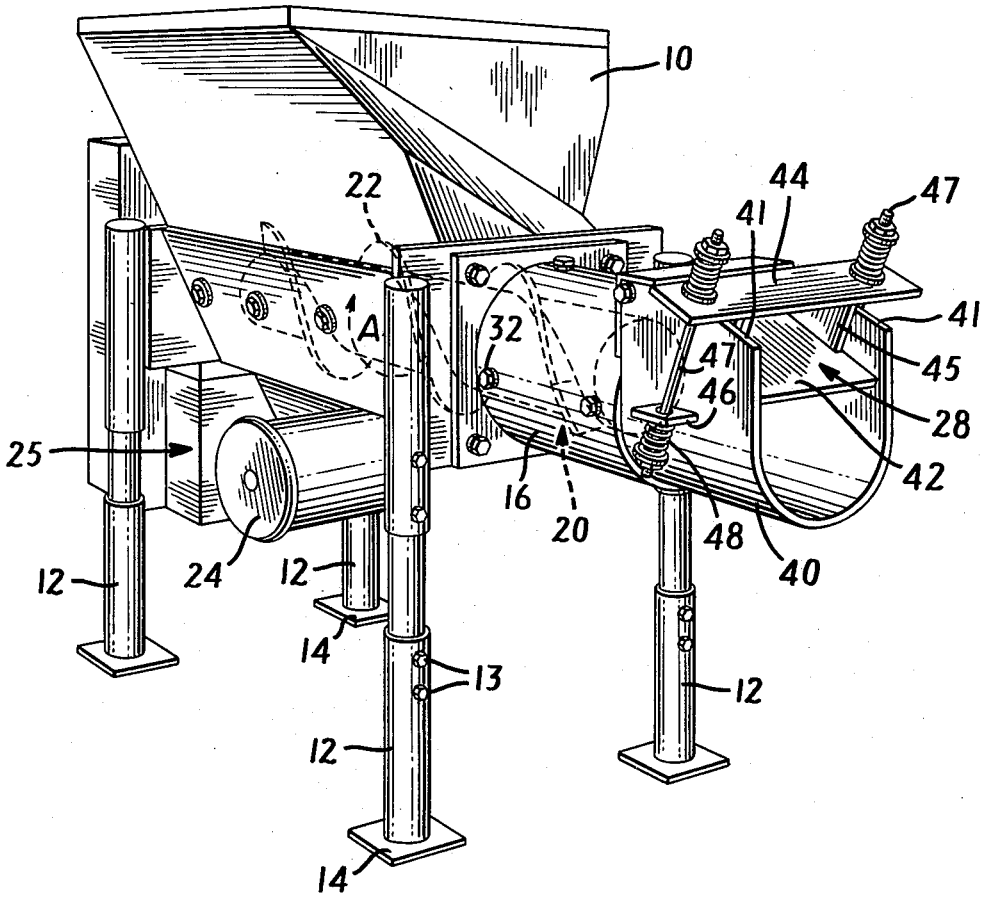
FIG. 1 is a perspective view showing the overall shredder-compactor apparatus constructed in accordance with the principles of the present invention.

One embodiment of a shredder-compactor apparatus constructed in accordance with the principles of the present invention is shown in FIG. 1. As used throughout this disclosure, the term refuse material is generic and includes garbage and waste material including paper, glass, plastic, metal cans and other similar metal articles as well as wet and dry solid organic and inorganic materials and waste. The apparatus comminutes the refuse material by shredding and shearing actions and compresses the shredded material to a tiny fraction of its original volume and in the process, extracts excess moisture from the material so that the plug of refuse which is discharged from the apparatus is in a highly compacted but relatively dry state.

The apparatus according to the invention comprises a hopper 10 for receiving the refuse material and for this purpose, the hopper is of the gravity feed type and has an open top end. Refuse material to be processed is deposited in the open end of the hopper and falls by gravity towards the bottom. The hopper 10 is supported by a plurality of adjustable legs 12. The legs each comprise a pair of telescoping tubular members which may be retracted or extended to the desired extent so as to adjust the height of the hopper. Screws 13 are threaded into the outer tubular member and are threadedly received within threaded bores in the inner tubular member to maintain the hopper at the desired elevation. At the base of each outer tubular member is secured a support plate 14 which may be used to secure the apparatus to a suitable foundation.

One end wall of the hopper 10 is provided with a circular opening and a compaction tube 16 is secured to that end wall of the hopper with its longitudinal axis concentric with the center of the circular opening. In this fashion, the interior of the hopper 10 is in direct communication with the interior of the compaction tube 16 to enable refuse material to flow from the former into the latter. An auger screw 20 is rotatably mounted at the base of the hopper 10 and extends into the compaction tube 16. The auger screw has a helical flight 22 which, in this embodiment, is of constant pitch throughout the length of the auger screw. The auger screw 20 may have a variable pitch with the larger pitch located in the hopper 10 and the smaller pitch located in the compaction tube 16 in order to have a larger span of the helical flight coacting with the edge surfaces of the shredder bar, but this is not necessary. The auger screw 20 is rotationally driven by a reversible electric motor 24 acting through a transmission 25.

Figure 2:
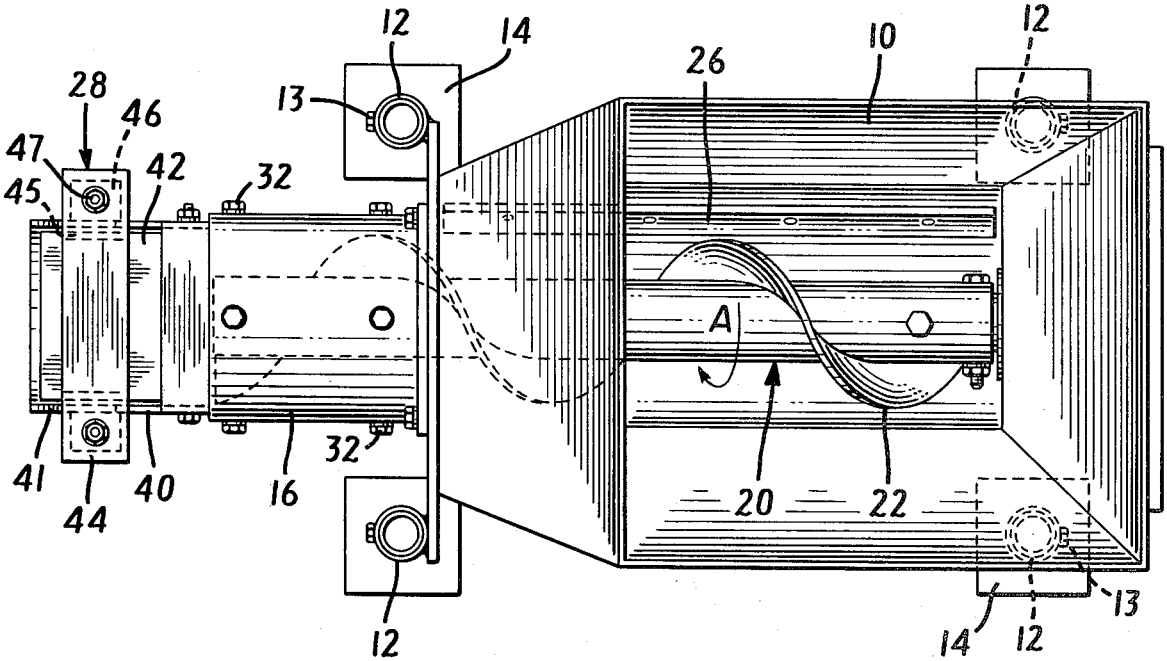
FIG. 2 is a top plan view of the apparatus shown in FIG. 1.

Within the lower end of the hopper 10 is provided a shredder or breaker bar 26, as seen in FIG. 2. The shredder bar 25 extends along the axial length of the hopper 10 in parallel with the auger screw and coacts with the helical flight 22 of the screw to shred, shear and tear the refuse material. As the auger screw is rotationally driven in the forward direction A, it feeds the refuse material against the shredder bar 26 and as the screw continues rotating, the helical flight 22 coacts with the shredder bar 26 to shred, shear, tear and otherwise comminute the refuse material and reduce its size. The helical flight thereafter operates to feed the material towards the compaction tube 16 in response to rotation of the auger screw in the forward direction A so that the refuse material is transported in a shredded condition from the hopper 10 into the compaction tube 16 wherein it is compacted. In order to ensure the desired degree of compaction, means are provided at the discharge end of the compaction tube for controlling and maintaining the back-pressure of the refuse material. This means comprises a latch assembly which will be described in more detail hereinafter.

Figure 5:
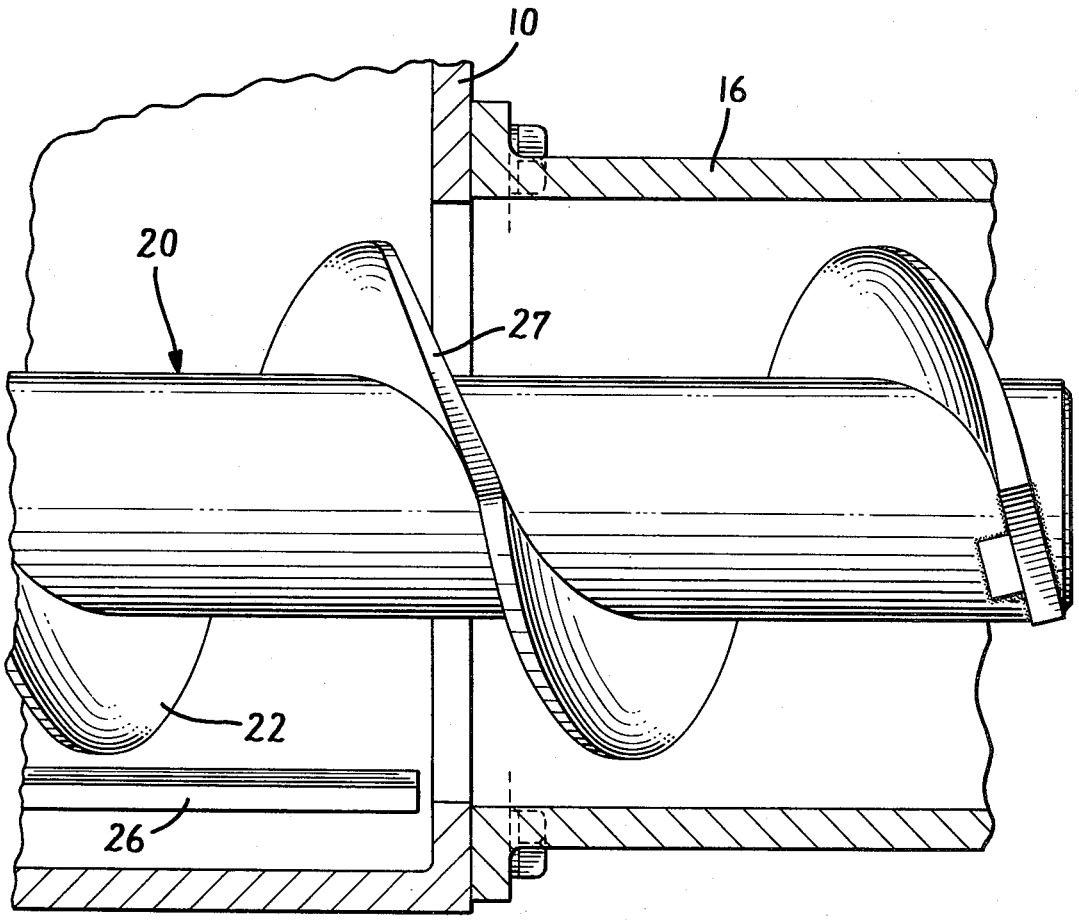
FIG. 5 is an exploded view, partly in section, showing the novel auger screw design according to the present invention.
Figure 6:
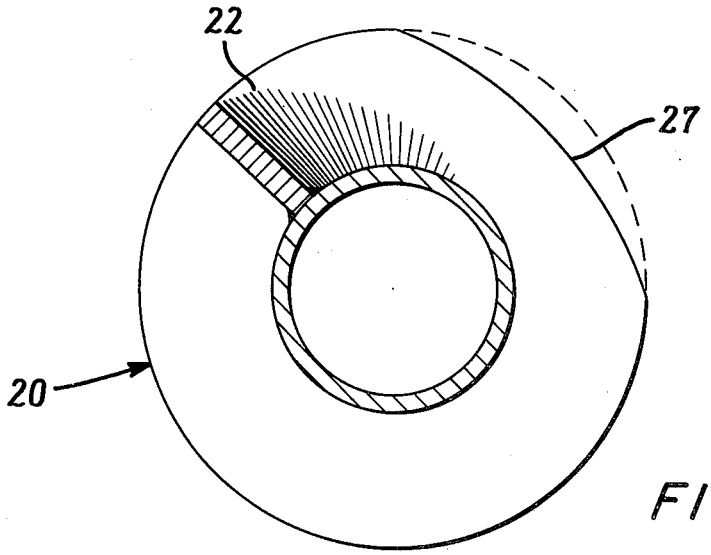
FIG. 6 is a cross-sectional view of the auger screw shown in FIG. 5.

In accordance with one aspect of the invention, means are provided on the auger screw 20 to alleviate blockage of refuse material in the transition zone between the hopper 10 and the compaction tube 16. This means is shown in FIGS. 5 and 6 and comprises a specially shaped portion of the helical flight 22. The specially shaped portion consists of an arcuate section 27 of the flight having a reduced dimension and being of lesser radial extent than the remaining portions of the helical flight. As seen in FIG. 6, this construction results in a helical screw profile which has a truncated portion as compared to the remaining screw profile, which is shown in dashed lines.

As seen in FIG. 5, the extent of the arcuate section 27 is approximately one-half pitch of the screw and the section 27 is disposed in the transition region between the hopper 10 and the compaction tube 16. More particularly, the reduced portion 27 of the helical flight 22 begins immediately upstream of the end wall of the hopper 10 so as to form a material-receiving opening between the helical flight 22 and the compaction tube 16 at the upstream end of the compaction tube. By such a construction, entry of the shredded and comminuted refused material is facilitated since an entrance opening is formed to receive the shredded material at the mouth of the compaction tube.

An important aspect of the present invention resides in recognizing that in the prior art shredder-compactor apparatus, the shredded material was not uniformly fed into the compaction tube and tended to form blockages at the entranceway. Once realizing this problem, it was effectively resolved by removing a portion of the helical flight to thereby alleviate the blockage and facilitate transporting of the material from the hopper 10, which has a relatively large volume per unit length, into the compaction tube 16 which has a much smaller volume per unit length.

Figure 7:
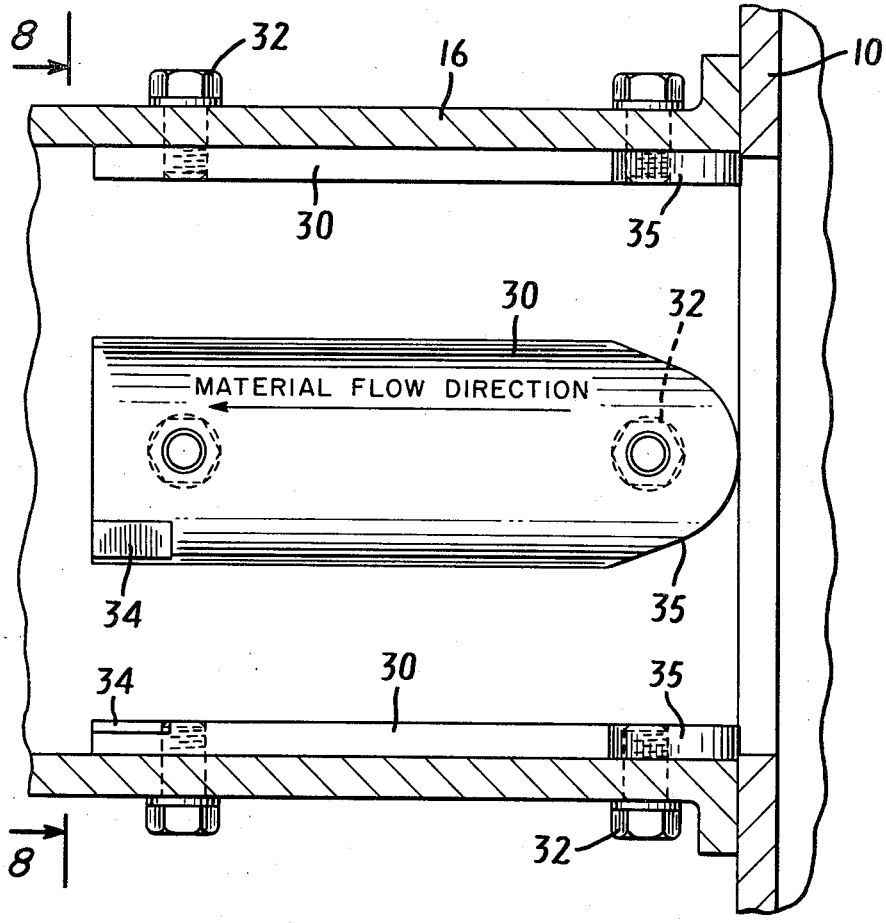
FIG. 7 is a longitudinal cross-sectional view of the compaction tube showing the novel wear plates of the present invention.
Figure 8:
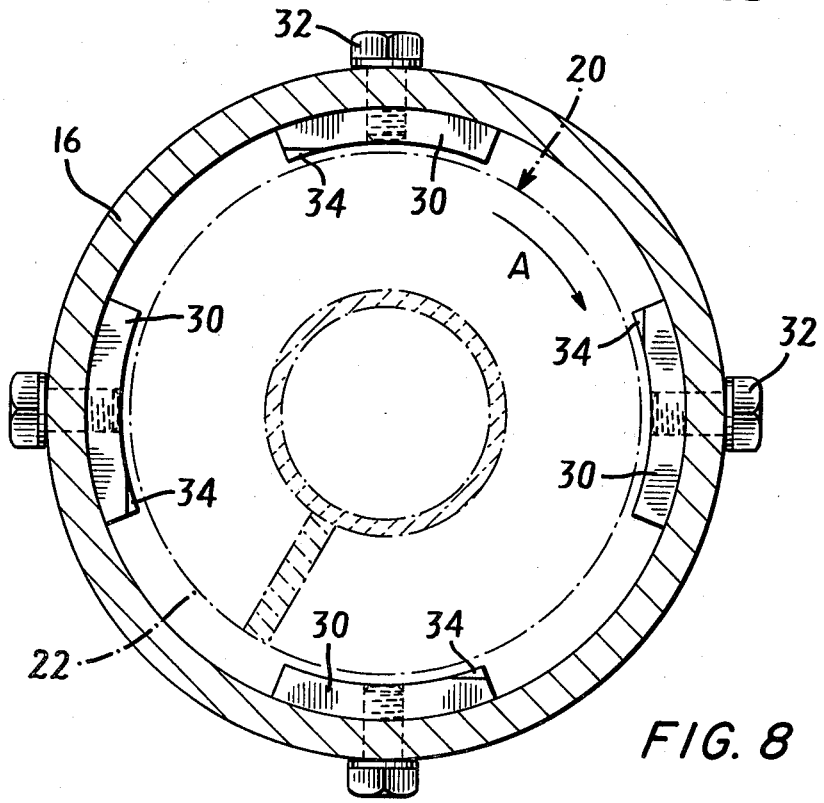
FIG. 8 is a cross-sectional view of the compaction tube taken along the lines 8-8 in FIG. 7.

In accordance with another aspect of the invention and as shown in FIGS. 7 and 8, a set of wear plates 30 are secured to the interior wall of the compaction tube 16. The wear plates each comprise angular sections which have the same angular contour as the compaction tube 16 so that they can fit snugly against the interior of the compaction tube. In the embodiment shown, four wear plates 30 are employed and the wear plates are disposed in symmetrical relationship about the interior wall of the compaction tube and extend substantially along its entire length. Each wear plate 30 is provided with a pair of tapped holes and a corresponding set of holes are provided in the wall of the compaction tube 16. In this fashion, the wear plates may be bolted to the interior wall of the compaction tube by means of bolts 32 which are applied from outside the tube.

The advantage of this type of connection is that the wear plates may be conveniently removed and replaced by simply unthreading the bolts 32. In addition, by applying the bolts from the outside, the bolt heads project outwardly from the exterior of the compaction tube rather than interiorly of the compaction tube and the latter arrangement is undesirable since the bolt heads would form sites for the refuse material to nucleate about and begin forming blockages.

The wear plates 30 are composed of a material which is softer than that of the auger screw to deliberately ensure that the wear plates themselves wear down rather than the auger screw. It has been found that glass products are especially detrimental to the apparatus and therefore it is indispensible that some relatively soft material be used for the wear plates so that they can be abraded or ground away by the glass particles in order to preserve the life of the auger screw and the compaction tube. For this purpose, the exposed surfaces of the auger screw may be hardfaced with an appropriate alloy, such as stellite, and the wear plates may be formed of rolled manganese steel having a manganese content of 11% to 14% and suitably prehardened to a Brinnell hardness of from 350 to 375.

Another important aspect of the present invention resides in recognizing the cause of failure of the prior art apparatus and devising a solution to the problem. In accordance with the invention, the wearing away of one or both of the auger screw and compaction tube has been satisfactorily prevented by interposing wear plates between the two. A wear plates are easily removable and when they wear down, are readily replaced. In this manner, the life of the auger screw and compaction tube is greatly increased. In addition, the wear plates function to form axial passages for assisting in advancing the refuse material through the compaction tube. With certain materials, such as cloth, fabric and large plastic sheets, these materials tend to move radially outwardly along the helical flight until they reach the crown portion and then they lock onto the crown portion and simply rotate with the auger screw rather than axially advance through the compaction tube. The presence of the wear plates 30 define circumferential discontinuities about the wall of the compaction tube which are effective to remove refuse material which clings to the crown portion of the helical flight and enable it to be axially advanced. Thus the wear plates function much in the manner of the axial slots of the prior art apparatus yet possess the advantage that they are easily replaceable in a fluid type manner so that material does not leak or seep past the wear plates to the exterior of the compaction tube.

The particular design of the wear plates is important and it has been found that the wear plates should have relief chamfers 34 at their leading end with respect to the direction of material flow, and on at least that side of the wear plate which forms the leading side with respect to the forward rotational direction of the auger screw. This is most clearly seen in FIG. 8 wherein the relief chamfers 34 are on the leading end of the wear plates with respect to the forward rotational direction A of the auger screw. Absent such a chamfer, the wear plates will develop cracks or even fracture at this location and this in turn will create sharp projections and form nucleating sites for the material. It is also important that the upstream end of the wear plates be formed with a smooth, arcuate contour 35 since in this region, the refuse material has the greatest difficulty entering the compaction tube.

Figure 9:
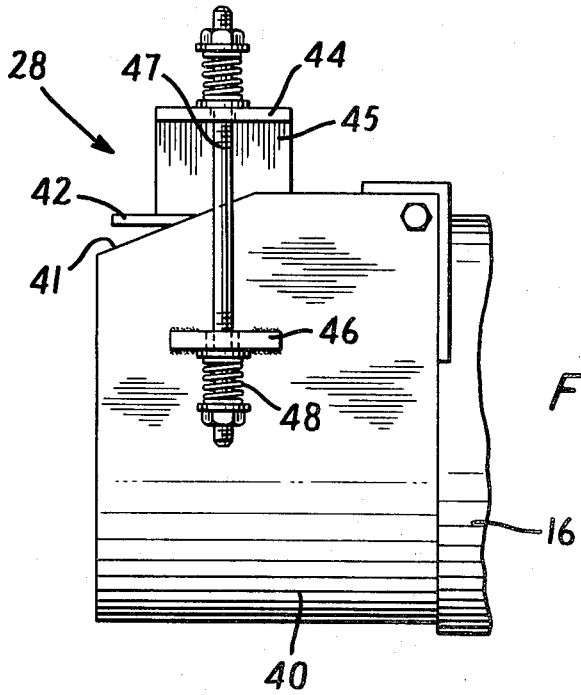
FIG. 9 is a side elevation view of the spring-loaded latch assembly for controlling the back-pressure of the refuse material.
Figure 3:
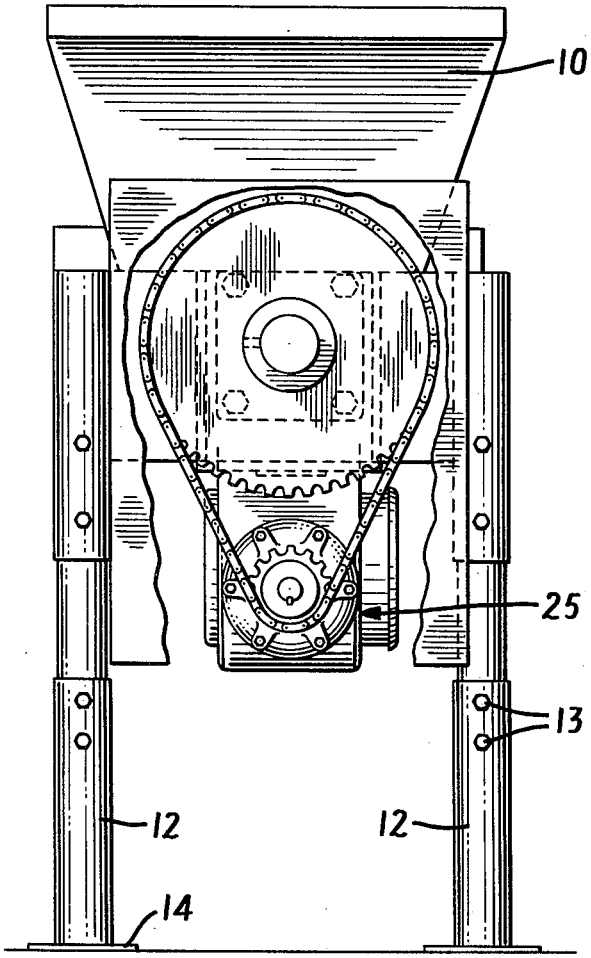
FIG. 3 is an end view of the apparatus shown in FIG. 1 as viewed from the hopper end of the apparatus.
Figure 4:
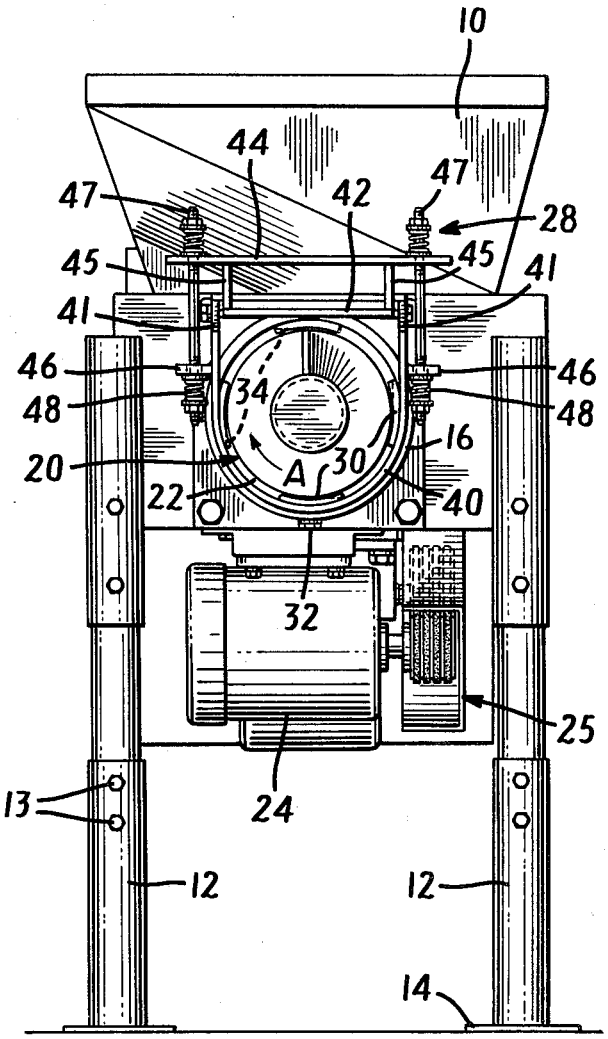
FIG. 4 is an end view of the apparatus shown in FIG. 1 as viewed from the compaction tube end of the apparatus.

In accordance with another aspect of the present invention, the shredder-compactor apparatus is provided with means for controlling and maintaining the back-pressure applied to the compacted refuse material as it approaches the discharge end of the compaction tube. This means comprises a spring-loaded latch assembly 28 which is best seen in FIGS. 1 and 9. The latch assembly comprises an arcuate guide member 40 connected directly to and forming an extension of the compaction tube 16. The guide member has a generally U-shaped configuration and the upper edges of the two opposed side walls are provided with inclined portions 41. A pressure plate 42 is mounted for tilting movement within the guide member 40 between the opposing side walls thereof, as shown in FIG. 1.

The pressure plate 42 normally assumes the inclined position shown in FIG. 1 and this defines the normal position. Mounting means movably mount the pressure plate for upward tilting movement, and biasing means coacts with the mounting means to maintain and bias the pressure plate into its normal position. The mounting means comprises a latch plate 44 which is rigidly attached to the pressure plate by means of connecting side plates 45. The latch plate, side plates and pressure plate are all preferably welded together to form an integral unit and the latch plate 44 rests upon the inclined portions 41 thereby defining the normal position of the pressure plate 42. The mounting means further includes a pair of flanges 46 welded to the outer sides of the guide member 40. Holes are provided in the flanges 46 and bolts 47 extend through the holes in the flanges and are bolted at one end to the latch plate 44.

Biasing springs 48 in the form of helical compression springs surround the other ends of the bolts 47 at a location beneath the flanges 46 and the compression springs are held on the bolts by suitable washers and nuts. In this manner, the biasing springs 48 bias the latch plate and the pressure plate into the normal position and resist upward tilting movement thereof and in this manner, establish the normal back-pressure which is to be applied to the refuse material.

As the apparatus operates, the compacted refuse material discharges from the compaction tube 16 and flows through the opening defined by the guide member 40 and the pressure plate 42. Due to the inclination of the pressure 42, the material is further constrained and a suitable back-pressure is applied thereto. If the volume of compacted refuse material is too great and will not fit through the exit opening, the continued operation of the apparatus will cause an increased pressure to be applied by the material onto the pressure plate 42 tending to tilt the pressure plate upwardly. The biasing springs 48 resist any such upward tilting movement of the pressure plate and in this manner, a suitable back-pressure is applied to the material.

However, when the pressure exerted by the refuse material exceeds a predetermined level, the opposing force offered by the biasing springs is overcome and the pressure plate tilts upwardly against the biasing action of the springs. Of course, the upward tilting of the pressure plate stretches the biasing springs 48 and accordingly increases the biasing force whereupon an increased back-pressure is applied to the refuse material. This increased back-pressure will tend to slow down the compaction process and as soon as the excess volume of compacted material passes through the exit opening, the biasing springs will return the pressure plate 42 to its normal position. The normal backpressure applied by the pressure plate 42 can be easily adjusted by tightening or loosening the nuts at the end of the bolts 48 to either further compress or relax the compression springs 48.

In accordance with a further aspect of the present invention, means are provided to effect both manual and automatic control of the auger screw rotation in the forward and reverse directions. In the manual mode, the auger screw may be selectively rotated in the reverse direction at any desired time whereas in the automatic mode, the auger screw cyclically operates first in the forward direction for a predetermined time and then in the reverse direction so as to assist in feeding the refuse material from the hopper to thereby prevent jamming and blockage of the material and to dislodge any material blockages which may occur. One type of control circuitry for controlling the auger screw rotation is shown schematically in FIG. 10. For the sake of clarity, many of the electric components which normally constitute part of the motor control circuitry have been omitted since they are not needed to explain nor understand the forward-reverse mode of operation of the apparatus.

The drive motor 24 comprises a conventional three-phase induction motor which is supplied, in known fashion, with three-phase power. A set of relay contacts **66*a* of a forward motor relay 66 and a set of relay contacts 68*a* of a reverse motor relay 68 are connected between the field windings of the motor and the power supply so as to control the rotational direction of the motor in dependence upon which of the two sets of relay contacts are closed. When the relay contacts 66a are closed, the three-phase power is supplied to the motor in the proper sequence to effect forward rotation of the motor and when the relay contacts 68a** are closed, the three-phase power is supplied in the proper sequence to effect reverse rotation of the motor.

Figure 10:
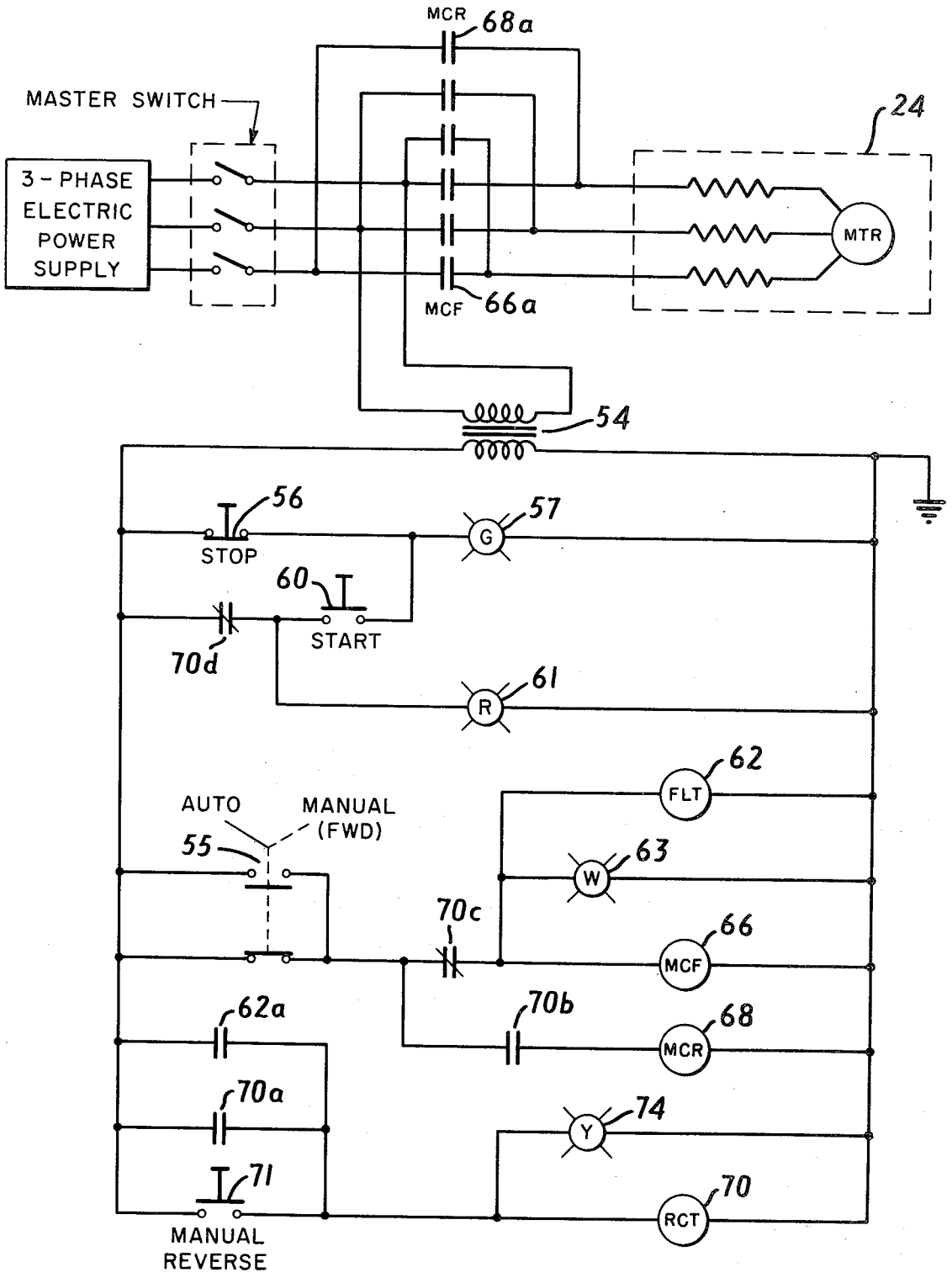
FIG. 10 is a schematic diagram of the motor control circuitry.

Electric energy is tapped from two of the three-phase windings and applied through a transformer 54 to the control circuitry. One terminal of the transformer secondary is grounded and the other terminal is the high voltage terminal. The remaining components of the control circuitry are connected across the transformer 54 as shown in FIG. 10 and include a two-position toggle switch 55 which is manually movable to an automatic position or a manual position. A stop push-button 56 is connected in series with a green pilot light 57 and this series circuit is connected across the transformer 54. A start push-button 60 is connected between the high voltage terminal and one side of the green pilot light 57. A red pilot light 61 is connected between one side of the start push-button 60 and ground.

Connected between a junction point of the toggle switch 55 and ground are a forward limit timer 62, a white pilot light 63, the forward motor relay 60, and the reverse motor relay 68. A reverse cycle timer 70 is grounded on one side and is connected on its other side to a parallel circuit comprised of a reverse push-button 71, normally open relay contacts **70*a* of the reverse cycle timer 70, and normally open relay contacts 62*a* of the forward limit timer 62. In addition, a yellow pilot light 74 is connected in parallel with the reverse cycle timer 70. The reverse cycle timer 70 also has another set of normally open relay contacts 70*b* which are connected in series with the reverse motor relay 68 and a further set of normally closed relay contacts 70*c* which are connected between the toggle switch 55 and both the forward limit timer 62 and the forward motor relay 66. In addition, another set of normally closed relay contacts 70*d* are connected between the high voltage terminal of the transformer 54 and the start push-button 60. The reverse motor relay 68 has a set of normally closed relay contacts 68*a* connected in series with an off-delay timer 75.**

A brief description of the operation of the control circuitry will be given to simplify its understanding. When it is desired to energize the drive motor 24, and assuming the condition wherein all of the timers have been reset and are ready to begin new cycles, a master switch is closed to supply three-phase electric power to the drive motor 24 whereupon electric power is supplied to the transformer 54 and through the closed contracts 70*d* of the reverse cycle timer to the red pilot light 61 causing this light to turn on. When the red pilot light is energized, this signifies the condition that power is supplied to the apparatus but the apparatus has not yet commenced operation. When it is desired to commence operation, the start push-button 60 is depressed thereby closing the circuit of the green pilot light 57 causing this light to turn on and this condition indicates that the apparatus is ON and in readiness to commence operation.

If the toggle switch 55 is then placed in the automatic position, the apparatus will commence operation in the automatic mode. The forward motor relay 66 will be energized thereby closing the forward motor contacts 66a whereupon three-phase power will be supplied to the drive motor 24 in the proper sequence to initiate forward rotation of the drive motor. Thus the auger screw 20 will commence rotation in the forward direction A and the refuse material will be continuously shredded, compacted and discharged. At this time, the white pilot light 63 will be lit signifying that the auger screw is rotating in the forward direction A.

After the elapse of a predetermined time as determined by the forward limit timer 62, the forward limit timer contacts 62*a* will close whereupon electrical energy is immediately supplied to the reverse cycle timer 70. At the instant energy is supplied to the reverse cycle timer, the reverse cycle timer contacts 70c and 70*d* open and contacts 70*a* and 70*b* close thereby energizing the reverse motor relay 68. When energy ceases to be applied to the forward motor relay 66, its contacts 66*a* open and since the reverse motor relay is energized, its contacts 68*a* close whereupon the drive motor 24 is supplied with three-phase power in the proper sequence to effect reverse rotation. Thus the drive motor 24 is rapidly decelerated and immediately commences rotation in the reverse direction thereby driving the auger screw in the reverse direction B. Also at this time, the white pilot light 63 is shut off and the yellow pilot light 74 is lit to signify that the auger screw is rotating in the reverse direction. After the elapse of a predetermined time as established by the reverse cycle timer 70, the reverse cycle timer contacts 70*a* and 70*b* again open and the contacts 70*c* and 70*d* again close whereupon the cycle of operation starts over again. By way of example only, it has been found that with the forward limit timer 62 set with a 3-minute time and the reverse cycle timer 70 set with a 10-second time, this yields very good results as far as breaking up the refuse material and preventing blockage.

When it is desired to operate the apparatus in the manual mode, the toggle switch 55 is shifted to the manual position and an explanation will now be given of the manual mode assuming that the start push-button 60 has been depressed and the apparatus is in readiness to be run. During the manual mode, the forward-reverse sequence of rotation of the drive motor is cyclically repeated in exactly the same fashion as described above. However, in the manual mode, means are provided to enable the operator to effect reverse rotation of the drive motor at will and this is accomplished by depressing the reverse push-button 71. Any time that the drive motor 24 is being driven in the forward direction and the reverse push-button 71 is depressed, the reverse cycle timer 70 is immediately energized and the drive motor will rapidly decelerate and commence reverse rotation for a predetermined time as set by the reverse cycle timer. If it is desired to repeat the reverse cycle, then the reverse push-button 71 is simply depressed again, as frequently as desired, to control the extent of reverse rotation. In each instance, the drive motor 24 rotates in the reverse direction only for the period of time established by the reverse control timer.

Thus it may be appreciated that by the drive means of the present invention, the auger screw may be cyclically driven through a predetermined sequence of forward and reverse directions to assist in feeding the material from the hopper and to minimize blockage and jamming of the material within the apparatus. In addition, the drive motor 24 may be manually controlled and driven in the reverse direction whenever it is necessary to remove a material blockage.

The various features of the present invention have been described with reference to one preferred embodiment and obvious changes and modifications thereto will be apparent to those ordinarily skilled in the art and the present invention is intended to cover all such obvious changes and modifications which fall within the spirit and scope of the invention as defined in the appended claims.

What we claim is:

1. An apparatus for shredding and compacting refuse material comprising: a hopper for receiving therein refuse material to be shredded and compacted; a compaction tube connected to and in communication with said hopper; a rotary auger screw extending along said hopper and into said compaction tube, said auger screw having a helical flight operative in response to rotation of said auger screw to advance the refuse material from said hopper through said compaction tube while effecting compaction of the material during its advancement through said compaction tube; means disposed within said hopper and coacting with said auger screw for breaking and shredding the refuse material in response to rotation of said auger screw; means on said auger screw disposed at the region where said auger screw enters said compaction tube for facilitating entry of the shredded and partly compacted material into said compaction tube; and drive means for rotationally driving said auger screw.

2. An apparatus according to claim 1; wherein said means on said auger screw comprises a truncated portion of said helical flight having a lesser radical extent than the remaining portion of said helical flight thereby defining a material-receiving opening between the truncated flight portion and the receiving end of said compaction tube.

3. An apparatus according to claim 1; including means defining axial passages extending lengthwise along the interior of said compaction tube and coacting with said auger screw to assist in axially advancing the shredded and compacted material through said compaction tube and preventing the refuse material from clinging to and rotating with said auger screw.

4. An apparatus according to claim 3; wherein said means defining axial passages comprises a set of wear plates extending lengthwise along the interior of said compaction tube and secured thereto in circumferentially spaced-apart relationship, said wear plates being composed of a less hard material than that of said auger screw to ensure wearing away of said wear plates rather than said auger screw.

5. An apparatus according to claim 1; including means disposed at the discharge end of said compaction tube for controlling the back-pressure applied to the shredded and compacted material to maintain the back-pressure within predetermined limits.

6. An apparatus according to claim 5; wherein said means for controlling the back-pressure comprises a spring-loaded latch assembly comprising a generally U-shaped guide member connected to and forming an extension of said compaction tube, a pressure plate movably disposed within said guide member such that the shredded and compacted material presses thereagainst as it discharges from said discharge end of said compaction tube, mounting means mounting said pressure plate for tilting movement within said guide member from a normal position wherein said pressure plate defines with said guide member a given exit opening through which the discharging material passes to other positions wherein said pressure plate defines with said guide member exit openings larger than said given exit opening to accordingly vary the exit opening through which the discharging material passes in response to the pressure exerted on said pressure plate by the discharging material, and biasing means coacting with said mounting means for biasing said pressure plate to said normal position so as to maintain the back-pressure applied to the discharging material within said predetermined limits.

7. An apparatus according to claim 1; wherein said drive means includes means for rotationally driving said auger screw in both the forward and reverse directions to assist feeding the refuse material from said hopper to said compaction tube and to alleviate material blockages in said compaction tube.

8. An apparatus according to claim 7; wherein said drive means further includes means for rotationally driving said auger screw in both the forward and reverse directions in repeated cycles according to a predetermined program.

9. An apparatus for shredding and compacting refuse material comprising: a hopper for receiving therein refuse material to be shredded and compacted; a compaction tube connected to and in communication with said hopper; a rotary auger screw extending along said hopper and into said compaction tube, said auger screw having a helical flight operative in response to rotation of said auger screw to advance the refuse material from said hopper through said compaction tube while effecting compaction of the material during its advancement through said compaction tube; means disposed within said hopper and coacting with said auger screw for breaking and shredding the refuse material in response to rotation of said auger screw; means including a set of wear plates extending lengthwise along the interior of said compaction tube and removably secured thereto from exteriorly thereof in circumferentially spaced-apart relationship to define axial passages along the interior of said compaction tube and coacting with said auger screw to assist in axially advancing the shredded and compacted material through said compaction tube and preventing the refuse material from clinging to and rotating with said auger screw, said wear plates being composed of a less hard material than that of said auger screw to ensure wearing down of said wear plates rather than said auger screw; and drive means for rotationally driving said auger screw.

* * * * *